United States Patent [19]

Tamura et al.

[11] Patent Number: 5,035,828

[45] Date of Patent: Jul. 30, 1991

[54] SOLVENTS CONTAINING DICHLOROTETRAFLUOROPROPANE

[75] Inventors: Kohji Tamura, Kawanishi; Yukio Omure, Takatsuki; Satoshi Ide, Osaka, all of Japan

[73] Assignee: Daikin Industries, Ltd., Osaka, Japan

[21] Appl. No.: 452,478

[22] Filed: Dec. 19, 1989

[30] Foreign Application Priority Data

Dec. 20, 1988 [JP] Japan ..... 63-322395
Dec. 22, 1988 [JP] Japan ..... 63-324521
Dec. 22, 1988 [JP] Japan ..... 63-324522

[51] Int. Cl.[5] ..... C11D 7/30; C11D 7/50; C23G 5/028

[52] U.S. Cl. ..... 252/170; 252/162; 252/172; 252/364; 252/DIG. 9

[58] Field of Search ..... 252/364, 162, DIG. 9, 252/170, 172

[56] References Cited

U.S. PATENT DOCUMENTS 3,332,840 7/1907 Regan .
4,910,041 3/1990 Yanaghira et al. ..... 427/37
4,947,881 8/1990 Magid et al. ..... 8/142

FOREIGN PATENT DOCUMENTS 0308923 3/1989 European Pat. Off. .
8912674 12/1989 PCT Int'l Appl. .

*Primary Examiner*—Paul Lieberman
*Assistant Examiner*—J. E. Darland
*Attorney, Agent, or Firm*—Armstrong, Nikaido, Marmelstein, Kubovcik & Murray

[57] ABSTRACT

Solvents or solvent compositions comprising HCFC-234. The solvents can be used, instead of CFC-113, as solvents, diluents, cleaning agents, drying agents or dispersing agents. The solvent compositions of HCFC-234 with an aliphatic alcohol having 1 to 4 carbon atoms or with cyclohexane can give azeotropic compositions.

6 Claims, No Drawings

SOLVENTS CONTAINING DICHLOROTETRAFLUOROPROPANE

FIELD OF THE INVENTION

The present invention relates to solvents or azeotropic solvent compositions which contain a dichlorotetrafluoropropane (hereinafter referred to as "HCFC-234").

BACKGROUND OF THE INVENTION

Hitherto, 1,1,2-trichloro-1,2,2-trifluoroethane (hereinafter referred to as "CFC-113") is widely used alone or in mixtures with other organic solvents, preferably azeotropic mixtures, as solvents, washing and cleaning agents, heat transfer media, pressure transfer media, or insulating media, because CFC-113 has various advantages such as incombustibility, low toxity and selective solubility power that it can dissolve fats, greases, waxes and the like without erosion of metals and high molecular compounds like rubbers and plastics.

Recently, there has been rising troubles that chlorofluoroethane compounds like CFC-113 in which all hydrogen atoms are substituted by chlorine atoms and fluorine atoms (hereinafter referred to as "perhaloethanes") produce global atomospheric pollutions, that is, the perhaloethanes destroy the ozone layer encircling the earth. Accordingly, the use of the perhaloethanes must be quickly reduced.

For reducing an amount of the perhaloethane there is proposed a method of using mixed solvents of CFC-113 with organic solvents other than the perhaloethanes. According to the mixed solvents, however, an amount of the perhaloethanes cannot be reduced beyond a give amount because of lowering their performance, particularly lowering their selective solubility power. In addition, when using as solvents, the mixed solvents should have important properties such that the liquid composition can be easily controlled and that the used solvents can be easily collected and recycled. Also the mixed solvents are desired to use in vapor washing method. Though azeotropic mixtures satisfy the above requirements, it is very difficult to find such azeotropic mixtures. Accordingly, the development of new solvents is limited from this viewpoint, and thus there has been found no practically usable solvent which can be used instead of the perhaloethanes.

There have been researched various solvents which do not contain the perhaloethanes. However, from this approach an effective solvent cannot be found.

An object of the present invention is to provide solvents comprising HCFC-234, especially consisting essentially of HCFC-234 which has a good wax cleaning property, incombustibility, low toxity and chemical stability equal to or more than those of CFC-113, and has a selective solubility power to dissolve and remove stains such as waxes without erosion of plastics, rubbers and metals, and further may not destroy the ozone layer in comparison with CFC-113.

Another object of the present invention is to provide azeotropic solvent compositions comprising HCFC-234 and an alcohol which do not contain CFC-113 and have an enhanced solubility power to fluxes in comparison with CFC-113 in addition to the above effects of HCFC-234.

An object of the present invention is to provide azeotropic solvent compositions comprising HCFC-234 and cyclohexane which do not contain CFC-113 and can sufficiently remove paints and printing inks more than CFC-113 in addition to the above effects of HCFC-234.

SUMMARY OF THE INVENTION

According to the present invention there can be provided a solvent and solvent composition which comprises HCFC-234. The preferred solvent composition are azeotropic mixtures of HCFC-234 with an aliphatic alcohol having 1 to 4 carbon atoms or with cyclohexane.

DETAILED DESCRIPTION

HCFC-234 is a known compound, but has not been used as a solvent. HCFC-234 has isomers such as 1,1-dichloro-2,2,3,3-tetrafluoropropane (b.p. 77.5° C.), 1,1-dichloro-1,3,3,3-tetrafluoropropane (b.p. 67° C.), 1,2-dichloro-1,2,3,3-tetrafluoropropane (b.p. 76° C.), 1,3-dichloro-2,2,3,3-tetrafluoropropane (b.p. 68° C.) (hereinafter referred to as "HCFC-234cc"), 1,2-dichloro-2,3,3,3-tetrafluoropropane (b.p. 64° C.) (hereinafter referred to as "HCFC-234bb"), 2,2-dichloro-1,1,3,3-tetrafluoropropane (b.p. 74° C.), 2,2-dichloro-1,3,3,3-tetrafluoropropane (b.p. 70° C.), 2,3-dichloro-1,2,3,3-tetrafluoropropane (b.p. 71° C.), 3,3-dichloro-1,2,2,3-tetrafluoropropane (b.p. 73° C.), 1,1-dichloro-2,3,3,3-tetrafluoropropane (b.p. 70° C.), 1,2-dichloro-1,3,3,3-tetrafluoropropane (b.p. 70° C.), 1,3-dichloro-1,2,3,3-tetrafluoropropane (b.p. 71° C.), 1,3-dichloro-1,2,2,3-tetrafluoropropane (b.p. 70° C.), 2,3-dichloro-1,1,3,3-tetrafluoropropane (b.p. 72° C.), 3,3-dichloro-1,1,2,3-tetrafluoropropane (b.p. 74° C.) and 1,3-dichloro-1,1,3,3-tetrafluoropropane (b.p. 47° C.) (hereinafter referred to as "HCFC-234fa").

HCFC-234 is incombustible and chemically stable, and has low toxity to a living body. Also, HCFC-234 can selectively dissolve fats, waxes, fluxes, inks, paints and the like without eroding rubbers, plastics and metals. Further HCFC-234 may not destroy the ozone layer in comparision with CFC-113.

According to the present invention, HCFC-234 can be used alone for various technical fields instead of CFC-113, for instance, as cleaning solvents for removing paraffins, animal and vegetable oils, processing oils, for removing waxes which are used for temporary fixing in cutting and abrasive preparation steps of quartz, ceramics or silicon wafers of semiconductor, for removing adhesive tapes, and for removing paints and inks; as solvents or diluents for paints and inks; as dispersing agents for ceramic powders and metal powders; as drying agent for wetted products; and also as heat transfer media, insulating agents, and pressure transfer media.

As mentioned above, HCFC-234 includes the isomers. The isomers of HCFC-234 may be used alone or in a mixture thereof, or also in a mixture with chlorohydrocarbons, alcohols, ketones or petroleum solvents. In view of liquid controlling in the practical use, HCFC-234 is preferably used in a single isomer or in an azeotropic mixture.

According to the present invention, the azeotropic solvent compositions of HCFC-234 with an aliphatic alcohol having 1 to 4 carbon atoms can be provided.

The aliphatic alcohol can strongly dissolve polar materials. Examples of the alcohol are, for instance, methyl alcohol (b.p. 64.7° C.), ethyl alcohol (b.p. 78.3° C.), iso-propyl alcohol (b.p. 82.0° C.), n-propyl alcohol (b.p. 97.3° C.), t-butyl alcohol (b.p. 82.9° C.), and the like. An aliphatic alcohol having carbon atoms of more than 4 has a high boiling point, and thus it cannot give an azeotropic mixture with HCFC-234.

According to the solvent composition, an amount of expensive HCFC-234 can be decreased, while maintaining the good properties of HCFC-234. Particularly, the solvent composition can dissolve and remove rosin fluxes which are used for soldering on printed circuits in electric or electronic fields. Further, since the composition is azeotropic, it is easy to control the liquid composition and to collect and recycle the used composition. The azeotropic compositions are incombustible other than the composition of methyl alcohol. The solvent compositions are, of course, usable for the same uses as of HCFC-234.

HCFC-234 can give azeotropic compositions with the aliphatic alcohol having 1 to 4 carbon atoms. Examples of the azeotropic compositions are as follows:

| HCFC-234 (% by weight) | Alcohol (% by weight) | Azeotropic temp. (°C.) |
|---|---|---|
| HCFC-234cc (86.5–87.5) | Methyl alcohol (13.5–12.5) | 54.6 |
| HCFC-234cc (89.5–90.5) | Ethyl alcohol (10.5–9.5) | 61.8 |
| HCFC-234cc (90.5–91.5) | iso-Propyl alcohol (9.5–8.5) | 65.0 |
| HCFC-234cc (96.5–97.5) | n-Propyl alcohol (3.5–2.5) | 66.9 |
| HCFC-234cc (92.5–93.5) | t-Butyl alcohol (7.5–6.5) | 66.5 |

Azeotropic compositions can be obtained from the other isomers of HCFC-234 and the aliphatic alcohols (about 1 to 15% by weight).

The present invention can further provide azeotropic solvent compositions of HCFC-234 with cyclohexane. The azeotropic solvent compositions are useful for various fields and uses where CFC-113 is used, particularly useful for dissolving and removing paints, inks and fats without eroding plastics, rubbers and metals. Cyclohexane has a boiling point of 81° C. and can dissolve non-polar materials.

Cyclohexane can give azeotropic compositions with the isomers of HCFC-234, for example, an azeotropic composition of HCFC-234cc (85.0–86.0%) and cyclohexane (15.0–14.0%) having a lower azeotropic temperature of 65.7° C. The other isomers of HCFC-234 can also provide azeotropic solvent compositions in a range of cyclohexane content of about 10 to 20% by weight.

Since solvent compositions of HCFC-234 with cyclohexane are azeotropic, the compositions are easy to handle and recover. Further, the azeotropic solvent compositions show excellent solubility powers with respect to paints and inks containing, as a vehicle, rosin-modified phenol resin, rosin-alkyd resin and polyesters which are insufficiently dissolved by CFC-113.

HCFC-234 is chemically stable in similar degree of CFC-113, and the solvent compositions are also stable. Accordingly, though they can be used as they are, stabilizers may be added thereto.

It is preferred that he stabilizers can be distilled together with the solvent or compositions, more desirebly can form an azeotropic system, in addition that the stabilizers have a large stabilizing effect against the solvent or compositions.

Examples of the stabilizers are, for instance, aliphatic nitro compounds such as nitromethane, nitroethane and nitropropane; acetylene alcohols such as 3-methyl-1-butyne-3-ol and 3-methyl-1-pentyne-3-ol; epoxides such as glycidol, methyl glycidyl ether, allyl glycidyl ether, phenyl glycidyl ether, 1,2-butylene oxide, cyclohexene oxide and epichlorohydrin; ethers such as dimethoxymethane, 1,2-dimethoxyethane, 1-4-dioxane and 1,3,5-trioxane; unsaturated hydrocarbons such as hexene, heptene, octene, 2,4,4-trimethyl-1-pentene, pentadiene, octadiene, cyclohexene and cyclopentene; olefinic alcohols such as allyl alcohol, 1-butene-3-ol and 3-methyl-1-butene-3-ol; acrylates such as methyl acrylate, ethyl acrylate and butyl acrylate; and the like. Nitromethane is a preferred stabilizer. These stabilizers can be used alone or in an admixture. In addition, other compounds may be used together with the above stabilizers. In such case synergic stabilizing effect can be obtained. Examples of the other compounds are, for instance, phenols such as phenol, trimethylphenol, cyclohexylphenol, thymol, 2,6-di-t-butyl-4-methylphenol, butylhydroxyanisole and isoeugenol; amines such as hexylamine, pentylamine, dipropylamine, diiso-propylamine, diisobutylamine, triethylamine, tributylamine, pyridine, N-methylmorpholine, cyclohexylamine, 2,2,6,6-tetramethylpyridine and N,N-diallyl-p-phenylenediamine; triazoles such as benzotriazole, 2-(2'-hydroxy-5'-methylphenyl) benzotriazole and chlorobenzotriazole; and the like.

Amount of the stabilizers varies on kinds of the stabilizers, and is generally 0.1 to 10%, preferably 0.5 to 5% to the composition. An amount of nitromethane is around 0.1 to 1.0%.

The present invention is more specifically described and explained by means of the following Examples. It is to be understood that the present invention is not limited to the Examples and various changes and modifications may be made in the invention without departing from the spirit and scope thereof.

PREPARATION EXAMPLE 1

A distillation flask was charged with a mixture (200 g) of HCFC-234cc (b.p. 68° C.) and the aliphatic alcohol shown in Table 1 (90 : 10 by weight). The mixture was distilled under normal pressure by using a distillation tower having a theoritical plate number of 30 to obtain a distillate having a boiling point lower than the boiling point of each mixed solvent.

As the result of gas chromatography analysis, the distillate had an aliphatic alcohol content shown in Table 1.

TABLE 1

| Aliphatic alcohol (b.p. °C.) | Lowest Azeotropic temp. (°C.) | Aliphatic Alcohol cont. in azeotropic composition (%) |
|---|---|---|
| Methyl alcohol (64.7) | 54.6 | 12.5–13.5 |
| Ethyl alcohol (78.3) | 61.8 | 9.5–10.5 |
| iso-Propyl alcohol (82.0) | 65.0 | 8.5–9.5 |
| n-Propyl alcohol (97.3) | 66.9 | 2.5–3.5 |
| t-Butyl alcohol (82.9) | 66.5 | 6.5–7.5 |

PREPARATION EXAMPLE 2

A distillation flask was charged with a mixture (200 g) of HCFC-234cc (b.p. 68° C.) and cyclohexane (b.p. 81° C.) (90 : 10 by weight). The mixture was distilled under normal pressure by using a distillation tower having a theoritical plate number of 30 to obtain a distillate having a boiling point of 65.7° C. which is lower than the boiling point of each mixed solvent.

As result of gas chromatography anylysis, the distillate consisted of 85.0 to 86.0% of HCFC-234cc and 15 to 14% of cyclohexane.

EXAMPLE 1

The degreasing and cleaning test was carried out in the following manner.

A bolt and nut (M5: 100 g) to which a spindle oil was adhered were immersed into 500 ml of the solvent shown in Table 1, and thereto ultrasonic waves were applied for 60 seconds. The bolt and nut were dipped in the solvent (500 ml) of another bath for 60 seconds, and then were subjected to vapor cleaning for 60 seconds. After that, an amount of the remaining oil on the bolt and nut was measured by an oil concentration analyzer available from Horiba, Ltd. The result are shown in Table 2.

EXAMPLE 2

The flux-cleaning test was carried out in the following manner.

To a substrate (10 cm×10 cm) for printed circuit a flux F-200V (Experimental No. 1) or MH-320V (Experimental No. 2 to 6) available from Kabushiki Kaisha Tamura Seisakusho was applied, and then soldered at 250° C. with a solder 63 Sn. The soldered printed circuit was immersed into the solvent (1l) shown in Table 2 at a boiling point for one minute. After that, an amount of ionic residue was measured by an omegameter available from Kenko Co., Ltd. The results are shown in Table 2.

EXAMPLE 3

The influences of the solvents to high molecular materials were studied in the following manner.

To the solvent (100 g) shown in Table 2 a plastic test piece (5 mm×50 mm×2 mm) shown in Table 2 was dipped. After allowing to stand for 4 hours in a thermostatic bath of 50° C., the change of weight and volume of the test piece were rapidly measured and evaluated according to the followings. The results are shown in Table 2.

(EVALUATION OF INFLUENCE TO PLASTICS)

◎ : Increased weight or volume being from 0% to less than 2%

○ : Increased weight or volume being from 2% to less than 5%

Δ : Increased weight or volume being not less than 5%

TABLE 2

| Experimental No. | Solvent (weight ratio) | Degreasing Test Conc. of remaining oil ($\mu g/cm^2$) | Flux-cleaning Test Ionic residue ($\mu g$ NaCl/$cm^2$) | Influences to Plastics | | |
|---|---|---|---|---|---|---|
| | | | | Polyethylene | Polyvinylchloride | ABS |
| 1 | HCFC-234cc | 0.25 | 1.5 | ◎ | ◎ | ○ |
| 2 | HCFC-234bb | 0.25 | 1.4 | ◎ | ○ | ○ |
| 3 | HCFC-234fa | 0.27 | 1.6 | ◎ | ○ | ○ |
| 4 | HCFC-234cc/ Methyl alcohol (87/13) | 0.28 | 1.0 | ○ | ◎ | ○ |
| 5 | HCFC-234cc/ Ethyl alcohol (90/10) | 0.30 | 1.2 | ◎ | ◎ | ○ |
| 6 | HCFC-234cc/ iso-Propyl alcohol (91/9) | 0.35 | 1.2 | ◎ | ○ | ○ |
| 7 | HCFC-234cc t-Butyl alcohol (93/7) | 0.40 | 1.3 | ◎ | ◎ | ○ |
| 8 | CFC-113 | 0.75 | 3.5 | ○ | ◎ | ○ |
| 9 | 1,1,2-trichloro-2,3,3,3-tetrafluoropropane | 0.24 | 1.4 | ○ | Δ | Δ |
| 10 | 1,3-dichloro-1,2,2,3,3-pentafluoropropane | 0.77 | 4.5 | ○ | ◎ | ○ |
| 11 | 1-chloro-2,2,3,3-tetrafluoropropane | 0.30 | 2.1 | ○ | Δ | Δ |
| 12 | 1-chloro-1,2,2,3,3-pentafluoropropane | 0.80 | 5.2 | ◎ | ◎ | ○ |

The other HCFC-234 isomers or azeotropic mixtures with the alcohols and cyclohexane gave approximately the same results as those shown in Table 2.

EXAMPLE 4

The other HCFC-234 isomers or azeotropic mixture with the alcohols and cyclohexane gave approximately the same results as those shown in Table 2.

Screen printing procedures were carried out on a paper by using a printing ink containing the vehicle shown in Table 3. The ink remained on the screen was wiped with a cloth to which the solvent composition prepared in Preparation Example 2 was impregnated. The removal of ink was observed with naked eyes. A comparative test was carried out by using CFC-113 in the same procedures. The results are shown in Table 3.

TABLE 3

| Vehicle of Ink | Removal of Ink | |
|---|---|---|
| | Prep. Ex. 2 | CFC-113 |
| Rosin-modified phenol resin | Good | Inferior |
| Rosin-alkyd resin | Good | Inferior |
| Ester resin | Good | Inferior |

The other azeotropic compositions of HCFC-234 isomers with cyclohexane gave approximately the same results as that shown in Table 3.

The solvents of the present invention comprise HCFC-234 which has excellent properties equal to or more than those of CFC-113, e.g. incombustibility, low toxity, chemical stability, and selective solubility power that various stains can be dissolved and removed without eroding plastics, rubbers and metals. Especially, HCFC-234 has a low influence to the ozone layer. The solvents may be prepared in the azeotropic compositions with an aliphatic alcohol having 1 to 4 carbon atoms or with cyclohexane. The azeotropic solvent compositions are advantageous in view points of low boiling point, high solubility power, easiness of controlling, collection and recycle. The solvents or solvent compositions are useful as solvents, diluents, cleaning agents, drying agents, dispersing agents for ceramic or metal powders, and the like.

What we claim is:

1. An azeotropic composition consisting essentially of 86.5–87.5% 1,3-dichloro-2,2,3,3-tetrafluoropropane and 13.5–12.5% methanol, respectively, having a boiling point of about 54.6° C. at normal pressure.

2. An azeotropic composition consisting essentially of 89.5–90.9% 1,3,-dichloro-2,2,3,3-tetrafluoropropane and 10.5–9.5% ethanol, respectively, having a boiling point of about 61.8° C. at normal pressure.

3. An azeotropic composition consisting essentially of 90.5–91.5% 1,3,-dichloro-2,2,3,3-tetrafluoropropane and 9.5–8.5% isopropanol, respectively, having a boiling point of about 65.0° C. at normal pressure.

4. An azeotropic composition consisting essentially of 96.5–97.5% 1,3,-dichloro-2,2,3,3-tetrafluoropropane and 3.5–2.5% n-propanol, respectively, having a boiling point of about 66.9° C. at normal pressure.

5. An azeotropic composition consisting essentially of 92.5–93.5% 1,3-dichloro-2,2,3,3-tetrafluoropropane and 7.5–6.5% tert-butanol, respectively, having a boiling point of about 66.5° C. at normal pressure.

6. An azeotropic composition consisting essentially of 85.0–86.0% 1,3-dichloro-2,2,3,3-tetrafluoropropane and 15.0–14.0% cyclohexane, respectively, having a boiling point of about 67.5° C. at normal pressure.

* * * * *